US009869133B2

(12) United States Patent
Chen et al.

(10) Patent No.: US 9,869,133 B2
(45) Date of Patent: Jan. 16, 2018

(54) METHOD OF USING SPRING LOADED BLOCKER TO RETAIN ROLLING CUTTERS OR MECHANICAL LOCK CUTTERS

(71) Applicant: Smith International, Inc., Houston, TX (US)

(72) Inventors: Chen Chen, Houston, TX (US); Yuri Burhan, Spring, TX (US); Jibin Shi, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 1035 days.

(21) Appl. No.: 14/081,593

(22) Filed: Nov. 15, 2013

(65) Prior Publication Data

US 2014/0131118 A1 May 15, 2014

Related U.S. Application Data

(60) Provisional application No. 61/726,734, filed on Nov. 15, 2012.

(51) Int. Cl.

| | |
|---|---|
| ***E21B 10/56*** | (2006.01) |
| ***E21B 10/573*** | (2006.01) |
| ***E21B 10/627*** | (2006.01) |
| ***E21B 10/633*** | (2006.01) |

(52) U.S. Cl.

CPC ..... *E21B 10/573* (2013.01); *E21B 10/627* (2013.01); *E21B 10/633* (2013.01)

(58) Field of Classification Search

CPC ..... E21B 10/573; E21B 10/62; E21B 10/633
See application file for complete search history.

(56) References Cited

U.S. PATENT DOCUMENTS

| | | | | |
|---|---|---|---|---|
| 4,104,344 | A | 8/1978 | Pope et al. | |
| 4,200,159 | A * | 4/1980 | Peschel | B22F 7/06 175/428 |
| 4,288,248 | A | 9/1981 | Bovenkerk et al. | |
| 4,553,615 | A * | 11/1985 | Grainger | E21B 10/12 175/354 |
| 5,127,923 | A | 7/1992 | Bunting et al. | |
| 7,703,559 | B2 | 4/2010 | Shen et al. | |
| 8,079,431 | B1 * | 12/2011 | Cooley | E21B 10/55 175/412 |

(Continued)

OTHER PUBLICATIONS

International Search Report and Written Opinion issued in corresponding International Application No. PCT/US2013/070345; dated Feb. 26, 2014 (13 pages).

*Primary Examiner* — Robert E Fuller
*Assistant Examiner* — Christopher Sebesta

(57) ABSTRACT

A cutting element assembly may include a sleeve; an inner cutting element in the sleeve; and a blocker retained in the sleeve with at least one locking device and covering a portion of a cutting face of the inner cutting element. Cutting tools may include a tool body; a plurality of blades extending radially from the tool body, each blade comprising a leading face and a trailing face; a plurality of cutter pockets on the plurality of blades; at least one cutting element in one of the cutter pockets; and at least one blocker positioned adjacent to a cutting face of the at least one cutting element and the leading face of the blade, the blocker being retained to the cutter pocket with at least one locking device.

24 Claims, 9 Drawing Sheets

(56) References Cited

U.S. PATENT DOCUMENTS

| | | | | |
|---|---|---|---|---|
| 2007/0079991 | A1* | 4/2007 | Cooley | B23B 27/12 175/57 |
| 2007/0278017 | A1* | 12/2007 | Shen | E21B 10/5673 175/426 |
| 2009/0020339 | A1 | 1/2009 | Sherwood, Jr. | |
| 2011/0297454 | A1 | 12/2011 | Shen et al. | |
| 2012/0073881 | A1 | 3/2012 | Shen et al. | |
| 2012/0273281 | A1 | 11/2012 | Burhan et al. | |

* cited by examiner

METHOD OF USING SPRING LOADED BLOCKER TO RETAIN ROLLING CUTTERS OR MECHANICAL LOCK CUTTERS

CROSS-REFERENCE TO RELATED APPLICATIONS

This application claims priority to U.S. Patent Application No. 61/726,734, filed on Nov. 15, 2012, the contents of which are herein incorporated by reference in their entirety.

BACKGROUND

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the first category are generally known as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category are typically referred to as "fixed cutter" or "drag" bits. Drag bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

An example of a prior art PDC bit having a plurality of cutters with ultra hard working surfaces is shown in FIGS. 1A and 1B. The drill bit 100 includes a bit body 110 having a threaded upper pin end 111 and a cutting end 115. The cutting end 115 typically includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 1B, a top view of a prior art PDC bit is shown. The cutting face 118 of the bit shown includes a plurality of blades 120, wherein each blade has a leading side 122 facing the direction of bit rotation, a trailing side 124 (opposite from the leading side), and a top side 126. Each blade includes a plurality of cutting elements or cutters generally disposed radially from the center of cutting face 118 to generally form rows. Certain cutters, although at differing axial positions, may occupy radial positions that are in similar radial position to other cutters on other blades.

A significant factor in determining the longevity of PDC cutters is the exposure of the cutter to heat. Exposure to heat can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. The thermal operating range of conventional PDC cutters is typically 700-750° C. or less.

As mentioned, conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

In convention drag bits, PDC cutters are fixed onto the surface of the bit such that a common cutting surface contacts the formation during drilling. Over time and/or when drilling certain hard but not necessarily highly abrasive rock formations, the edge of the working surface on a cutting element that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn PDC cutter acts as a friction bearing surface that generates heat, which accelerates the wear of the PDC cutter and slows the penetration rate of the drill. Such flat surfaces effectively stop or severely reduce the rate of formation cutting because the conventional PDC cutters are not able to adequately engage and efficiently remove the formation material from the area of contact. Additionally, the cutters are typically under constant thermal and mechanical load. As a result, heat builds up along the cutting surface, and results in cutting element fracture. When a cutting element breaks, the drilling operation may sustain a loss of rate of penetration, and additional damage to other cutting elements, should the broken cutting element contact a second cutting element.

Additionally, the generation of heat at the cutter contact point, specifically at the exposed part of the PDC layer caused by friction between the PCD and the work material, causes thermal damage to the PCD in the form of cracks which lead to spalling of the polycrystalline diamond layer, delamination between the polycrystalline diamond and substrate, and back conversion of the diamond to graphite causing rapid abrasive wear. The thermal operating range of conventional PDC cutters is typically 750° C. or less.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element assembly that includes a sleeve; an inner cutting element at least partially within the sleeve; and a blocker retained in the sleeve with at least one locking device and covering a portion of a cutting face of the inner cutting element.

In another aspect, embodiments disclosed herein relate to a cutting tool that includes a tool body; a plurality of blades extending radially from the tool body, each blade comprising a leading face and a trailing face; a plurality of cutter pockets on the plurality of blades; at least one cutting element in one of the cutter pockets; and at least one blocker positioned adjacent to a cutting face of the at least one cutting element and the leading face of the blade, the blocker being retained to the cutter pocket with at least one locking device.

Other aspects and advantages of the claimed subject matter will be apparent from the following description and the appended claims.

BRIEF DESCRIPTION OF DRAWINGS

Embodiments of the present disclosure are described with reference to the following figures. The same numbers are used throughout the figures to reference like features and components.

DETAILED DESCRIPTION

Embodiments disclosed herein relate generally to cutting elements and methods of retaining such cutting elements on a drill bit or other cutting tools. In particular, cutting elements of the present disclosure may be retained on fixed cutter drill bits or other cutting tools using a blocker. In some embodiments, blockers described herein may also allow the cutting element to rotate as the cutting element contacts the formation to be drilled, while at the same time retaining the cutting element on the drill bit. Cutting elements disclosed herein that are rotatably retained to a cutting tool may be referred to as a rotatable cutting element.

Figure 2:
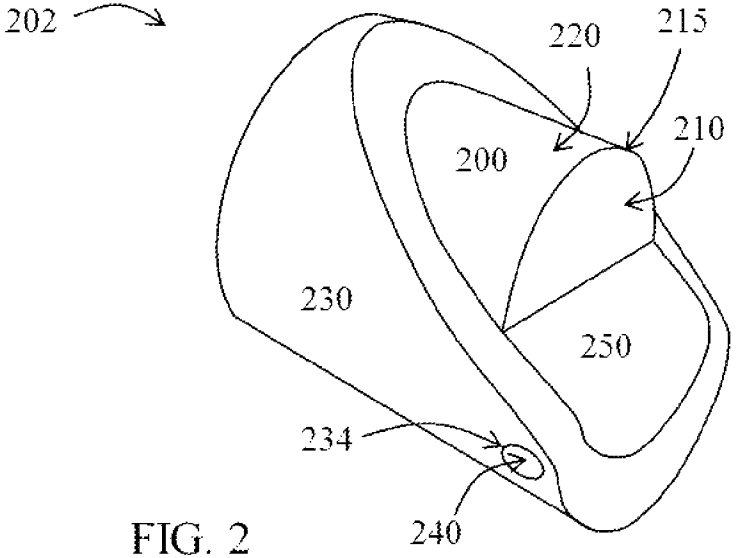
FIG. 2 shows a perspective view of a cutting element assembly according to embodiments of the present disclosure.

Cutting elements may be retained within a sleeve to form a cutting element assembly, which may then be secured to a cutting tool, or cutting elements may be directly secured to a cutter pocket formed in the cutting tool. For example, FIG. 2 shows a cutting element assembly including a cutting element that is rotatably retained within a sleeve using at least a blocker, according to embodiments of the present disclosure. As shown, the cutting element assembly 202 includes a sleeve 230, an inner cutting element 200 disposed in the sleeve 230, and a blocker 250, which is also disposed in the sleeve 230 adjacent to the cutting element 200. The cutting element 200 has a cutting face 210 and a body 220 extending axially downward from the cutting face 210. The blocker 250 covers a portion of the cutting face 210 of the inner cutting element 200 when assembled within the sleeve 230. Further, the blocker 250 is retained to the sleeve 230 with at least one locking device 240. The locking device may include, for example, a pin (and optionally a spring) inserted through a hole 234 formed in the sleeve 230 and into a corresponding hole formed within the blocker 250.

Figure 1A:
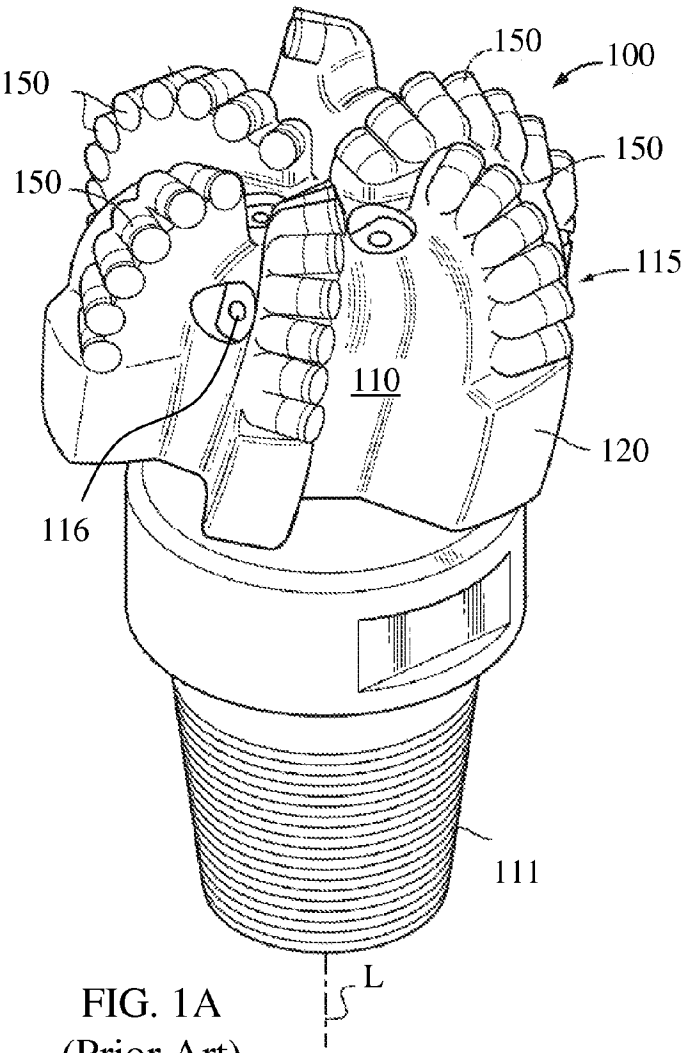
FIG. 1A (Prior Art)
FIGS. 1A and 1B show a side and top view of a conventional drag bit.
Figure 1B:
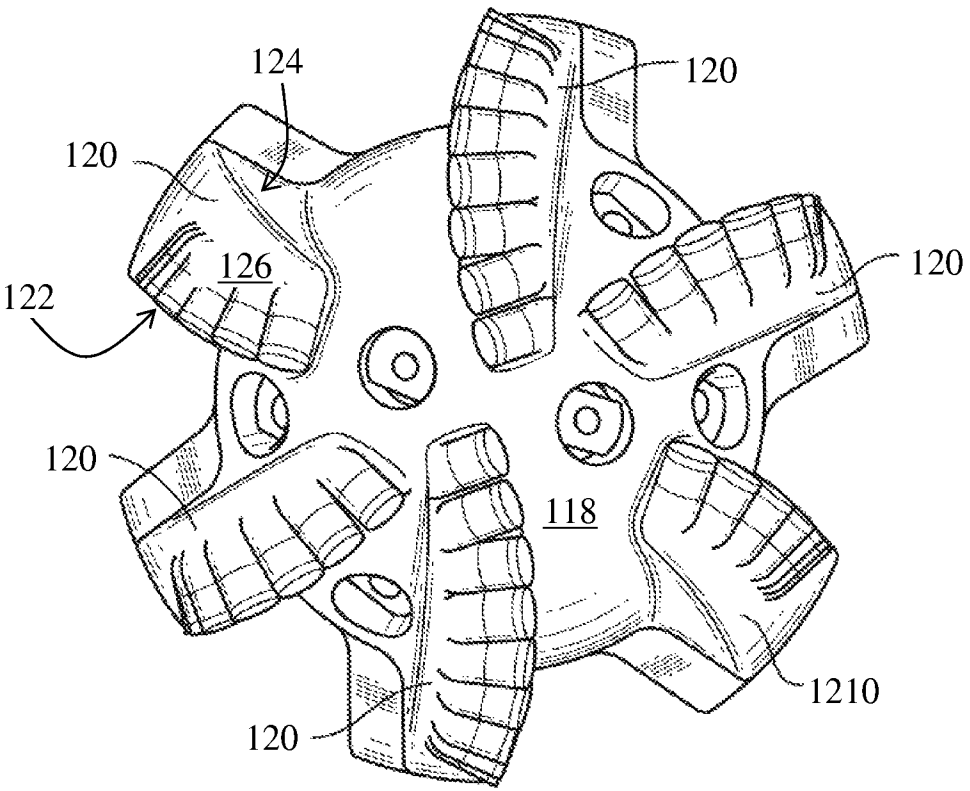
FIG. 1B (Prior Art)
Figure 3:
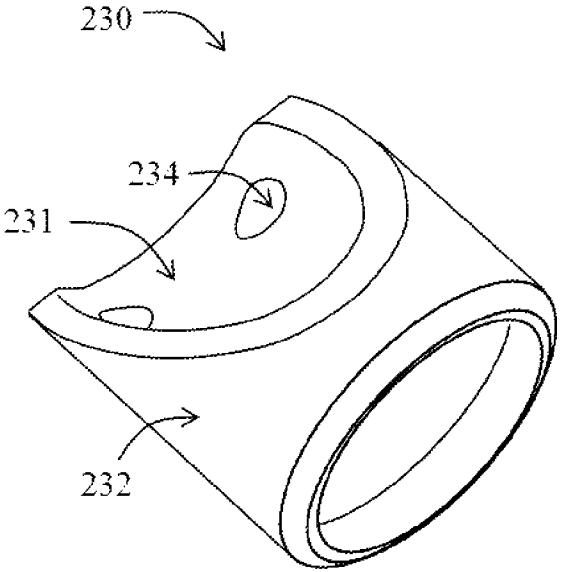
FIG. 3 shows a perspective view of a sleeve according to embodiments of the present disclosure.

FIG. 3 shows a perspective view of the sleeve 230 without the inner cutting element therein. The sleeve 230 has an outer surface 232 and an inner surface 231. The hole 234 extends through the thickness of the sleeve 230 wall, from the sleeve outer surface 232 to the sleeve inner surface 231. However, in some embodiments, a sleeve may have one or more blind holes, i.e., a hole that does not extend through the entire thickness of the sleeve wall, for example, extending from the sleeve inner surface a partial distance into the thickness of the sleeve wall, to receive a locking device. Further, in some embodiments, a sleeve may have a combination of one or more through holes (a hole extending through the entire thickness of the sleeve wall) and one or more blind holes.

Figure 4:
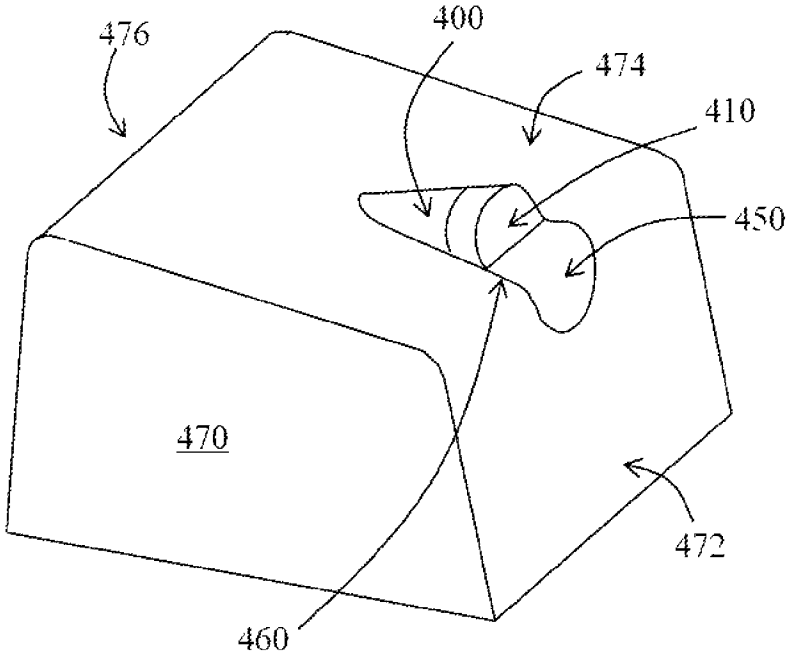
FIG. 4 shows a perspective view of a cutting element assembly according to embodiments of the present disclosure.

According to other embodiments, a cutting element may be assembled directly to a cutter pocket formed in a cutting tool. For example, FIG. 4 shows a perspective view of a section of a cutting tool blade 470 having a cutting element 400 assembled directly to a cutter pocket 460 formed therein (without the use of a sleeve). The blade 470 has a leading face 472, a top face 474 and a trailing face 476, wherein the cutter pocket 460 is formed at the intersection of the top face 474 and leading face 472. A cutting element 400 is disposed within the cutter pocket 460 and retained in the cutter pocket 460 with a blocker 450. To retain the cutting element 400, the blocker 450 is positioned adjacent to the cutting face 410 of the cutting element 400 and secured to the cutter pocket 460 at the leading face 472 of the blade 470, thereby preventing the cutting element 400 from axially dislodging from the cutter pocket 460. As shown, the blocker 450 may have an outer surface flush with the leading face 472 of the blade 470. However, in other embodiments, a blocker may have other shapes that do not correspond with the leading face of the blade. Further, the blocker 450 is retained to the cutter pocket 460 using at least one locking device (not shown) that extends between corresponding holes formed in the blocker 450 and the inner surface of the cutter pocket 460.

Figure 5:
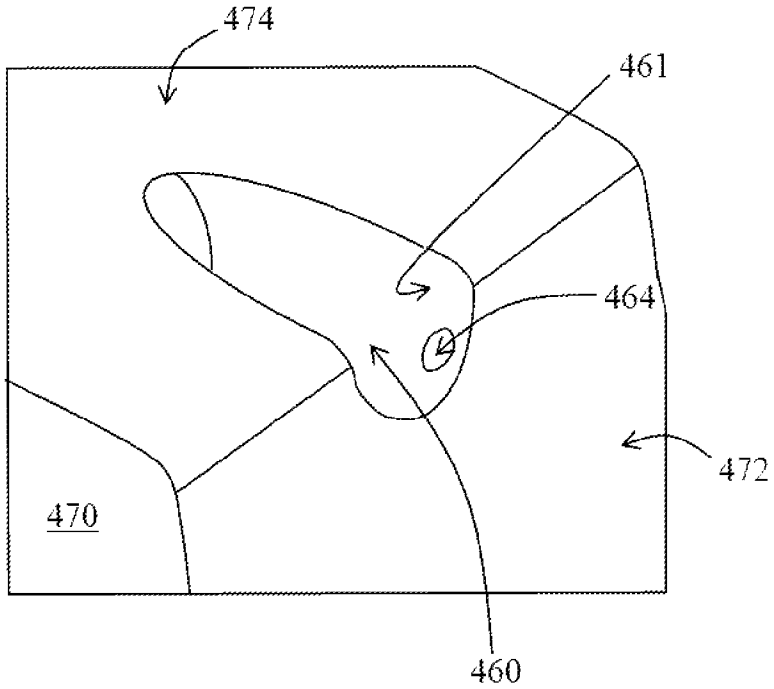
FIG. 5 shows a perspective view of a cutter pocket according to embodiments of the present disclosure.

FIG. 5 shows a perspective view of a section of a blade 470 of a cutting tool. The blade 470 has a cutter pocket 460 formed at the top face 474 and leading face 472 of the blade 470, without a cutting element assembled therein. The inner surface 461 of the cutter pocket 460 has two holes 464 (only one hole 464 is shown) formed therein to receive a locking device (not shown) upon assembly of the cutting element and blocker to the blade 470.

Figure 6:
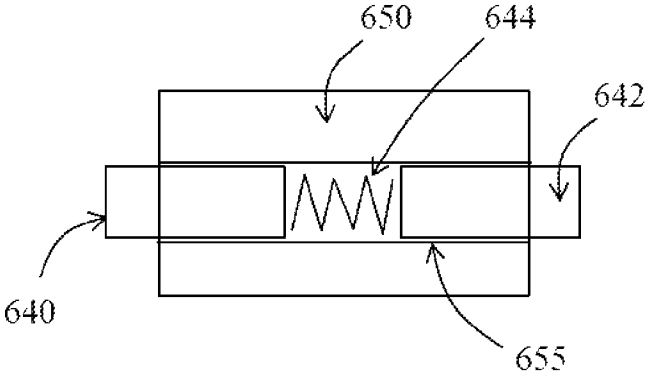
FIG. 6 shows a cross-sectional view of a blocker according to embodiments of the present disclosure.
Figure 8:
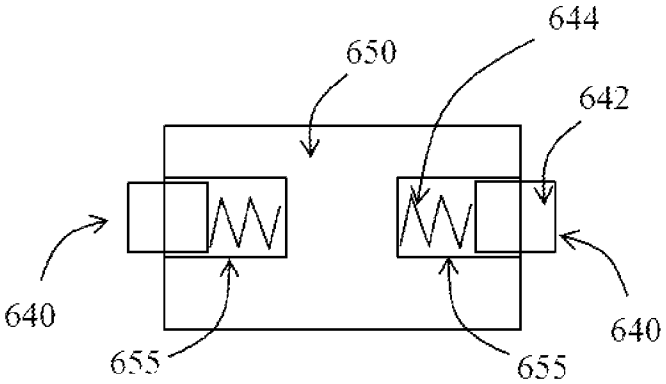
FIG. 8 shows a cross-sectional view of a blocker according to embodiments of the present disclosure.
Figure 7:
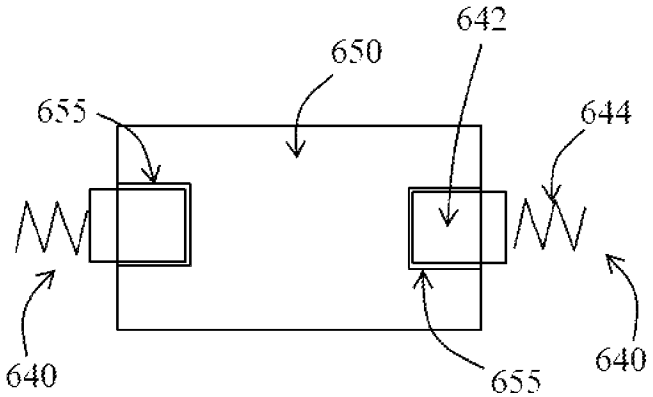
FIG. 7 shows a cross-sectional view of a blocker according to embodiments of the present disclosure.

Referring now to FIGS. 6-8, various locking devices are shown according to embodiments of the present disclosure. FIG. 6 shows a cross sectional view of a locking device 640 disposed in a hole 655 formed through the blocker 650. As shown, the locking device 640 has a spring 644 positioned between two pins 642. In such embodiments, once the blocker 650 and locking device 640 are assembled to a sleeve or cutter pocket, a portion of each pin 642 protrudes into holes formed in a sleeve or cutter pocket. Further, both the blocker hole 655 and the locking device 640 extend through the entire width of the blocker 650. FIG. 7 shows a cross sectional view of two locking devices 640, each locking device 640 partially disposed in a hole 655 formed in the blocker 650. As shown, the locking devices 640 each have a spring 644 and a pin 642, wherein the spring portion of each locking device is positioned outside the hole 655. In such embodiments, once the blocker 650 and locking devices 640 are assembled to a sleeve or cutter pocket, the spring 644 and a portion of the pin 642 in each locking device 640 are disposed in a hole formed in a sleeve or cutter pocket. Further, as shown, each blocker hole 655 and locking device 640 extend a partial distance into the blocker 650. FIG. 8 shows another example of two locking devices 640 disposed in blind holes 655 formed in a blocker 650. Each locking device 640 has a pin 642 and a spring 644 disposed in each hole 655, wherein a portion of each pin 642 protrudes outside of the blocker hole 655 (and into a corresponding sleeve/cutter pocket hole once assembled). Further, each blocker hole 655 extends a partial distance into the blocker 650. As shown, the blocker holes 655 are positioned opposite each other and extend along the same directional plane towards each other. However, other embodiments may have one or more blind holes extending a partial distance into the blocker from different directions and along different directional planes.

Locking devices of the present disclosure may be made of carbides, steels, ceramics, and/or hardened tool steel, for example, and may be adjustable or non-adjustable. For example, a locking device according to embodiments of the present disclosure may include springs, pins and/or balls. Further, locking devices of the present disclosure may include various types components having various shapes and sizes that protrude into both the blocker and the sleeve/cutter pocket. For example, cylindrical pins are shown in the figures for use in locking devices. However, pins may have a cross-sectional shape other than circular, such as rectangular, T-shaped, oval, etc. Furthermore, locking devices of the present disclosure may include springs with varying values of compressibility. For example, a spring forming part of a locking device may have a spring constant ranging from 1 lb/in to 1,300 lb/in. In other embodiments, a spring in a locking device may have a spring constant ranging from 3 lb/in to 2,000 lb/in.

Figure 10:
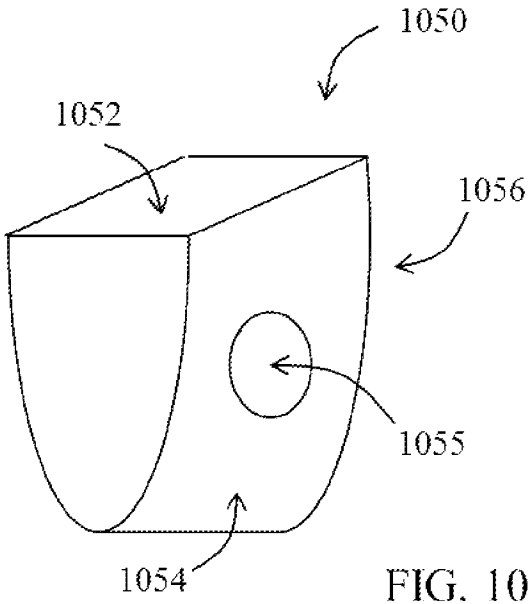
FIG. 10 shows a perspective view of a blocker according to embodiments of the present disclosure.
Figure 9:
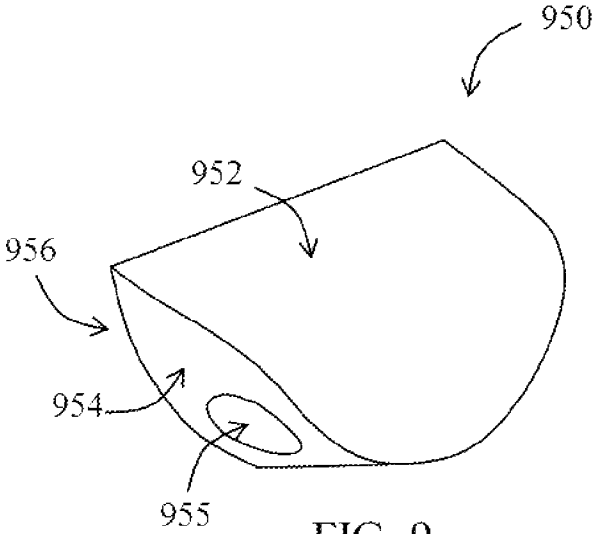
FIG. 9 shows a perspective view of a blocker according to embodiments of the present disclosure.

Referring now to FIGS. 9 and 10, various blockers according to embodiments of the present disclosure are shown. The blocker 950 shown in FIG. 9 has a side surface 954, which is positioned adjacent to a sleeve or cutter pocket inner surface upon assembly, and an outer surface 952, which is exposed in assembled form. For example, when assembling a blocker 950 directly to a cutter pocket on a blade of a cutting tool, the outer surface 952 of the blocker 950 is exposed at the leading face of the blade. One or more holes 955 are formed in the side surface 954 to receive a locking device (not shown). The blocker 950 also has an inside surface 956, which faces the cutting element once assembled. The inside surface 956 may or may not contact the cutting element in assembled form. For example, in some embodiments, a ball bearing may be disposed between the inside surface of a blocker and the cutting face of a cutting element such that the inside surface does not contact the cutting face. In such embodiments, a cavity or groove may be formed in the inside surface to limit movement of the ball bearing. In other embodiments, the inside surface of a blocker may be adjacent to and contact the cutting face of a cutting element. In such embodiments, the cutting face and/or the inside surface may be coated with diamond or other low-friction, hard bearing surface material. For example, the coating may include at least one layer of polycrystalline diamond, polycrystalline cubic boron, diamond like carbon ("DLC"), or other hard materials, such as carbides, nitrides, and borides, or a combination of such materials.

Another example of a blocker 1050 according to embodiments of the present disclosure is shown in FIG. 10. The blocker 1050 has a side surface 1054, which is positioned adjacent to sleeve or cutter pocket inner surface upon assembly, an outer surface 1052, which is exposed in assembled form, and an inside surface 1056, which faces the cutting element once assembled. One or more holes 1055 are formed in the side surface 1054 to receive a locking device (not shown) for assembly to the sleeve or cutter pocket. As shown, the outer surface 1052 includes an edge formed by two intersecting planar surfaces. The intersecting angle may be about 90° in some embodiments and greater than 90° in other embodiments. However, according to other embodiments, an outer surface of a blocker may have other combinations of planar and/or non-planar surfaces. For example, referring again to FIG. 9, the outer surface 952 of the blocker is a single non-planar surface having a curved shape. In some embodiments, the outer surface of a blocker may be shaped to correspond with the shape of the leading face and/or top face of a blade.

According to embodiments of the present disclosure, cutting elements may be rotatably retained within a sleeve or cutter pocket or fixedly retained within the sleeve or cutter pocket. Methods of rotatably retaining a cutting element within a sleeve or cutter pocket may include placing a blocker adjacent to the cutting face of the cutting element positioned in the sleeve or cutter pocket, wherein the sleeve or cutter pocket may prevent radial dislodgment of the cutting element and the blocker may prevent axial dislodgment of the cutting element. In such embodiments, at least a portion of the sleeve or cutter pocket may extend greater than 180° around the circumference of the cutting element while at least another portion of the sleeve or cutter pocket extends partially around the circumference of the cutting element to expose a cutting edge of the cutting element. The cutting edge of the cutting element is formed at the intersection of the cutting face and outer side surface of the cutting element.

For example, referring again to FIG. 2, a portion of the sleeve 230 extends greater than 180° around the circumference of the cutting element while another portion of the sleeve 230 extends partially around the circumference to expose the cutting edge 215 of the cutting element 200. As shown, the portion of the sleeve extending greater than 180° around the circumference of the cutting element 200 includes a portion of the sleeve 230 extending around the entire circumference of the cutting element 200. However, other embodiments may include a sleeve or cutter pocket extending greater than 180° but less than the entire circumference of the cutting element to radially retain the cutting element. Further, as shown in FIG. 2, the sleeve 230 extends a gradually decreasing distance around the circumference of the cutting element 200 along the axial length of the cutting element 200. Thus, the portion of the sleeve 230 distal from the cutting face 210 of the cutting element 200 extends the greatest distance around the circumference of the cutting element, while the portion of the sleeve 230 at the cutting face 210 extends the least distance around the circumference of the cutting element 200. The sleeve 230 also extends an axial distance beyond the cutting face 210 of the cutting element 200. This portion of the sleeve 230 attaches to and partially surrounds the blocker 250, and may be referred to as the blocker portion of the sleeve.

Figure 11:
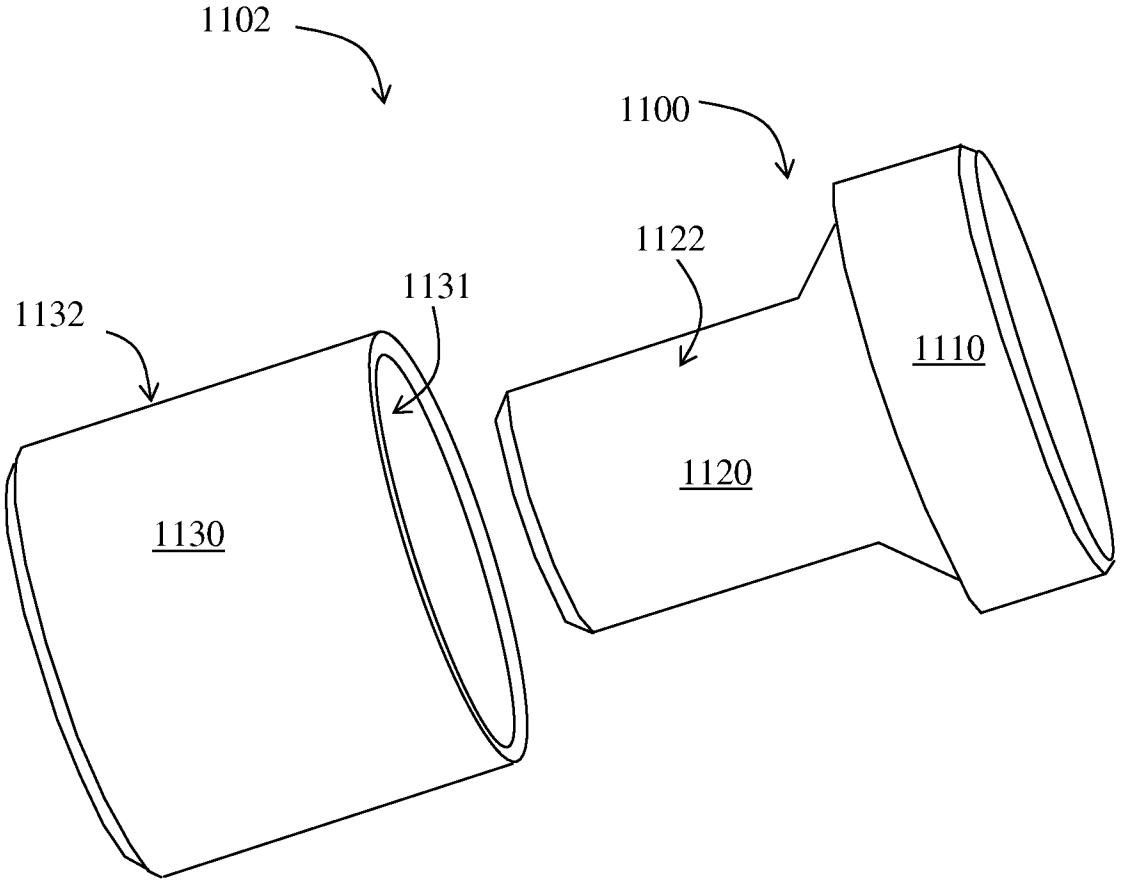
FIG. 11 shows a perspective view of a cutting element assembly according to embodiments of the present disclosure.
Figure 12:
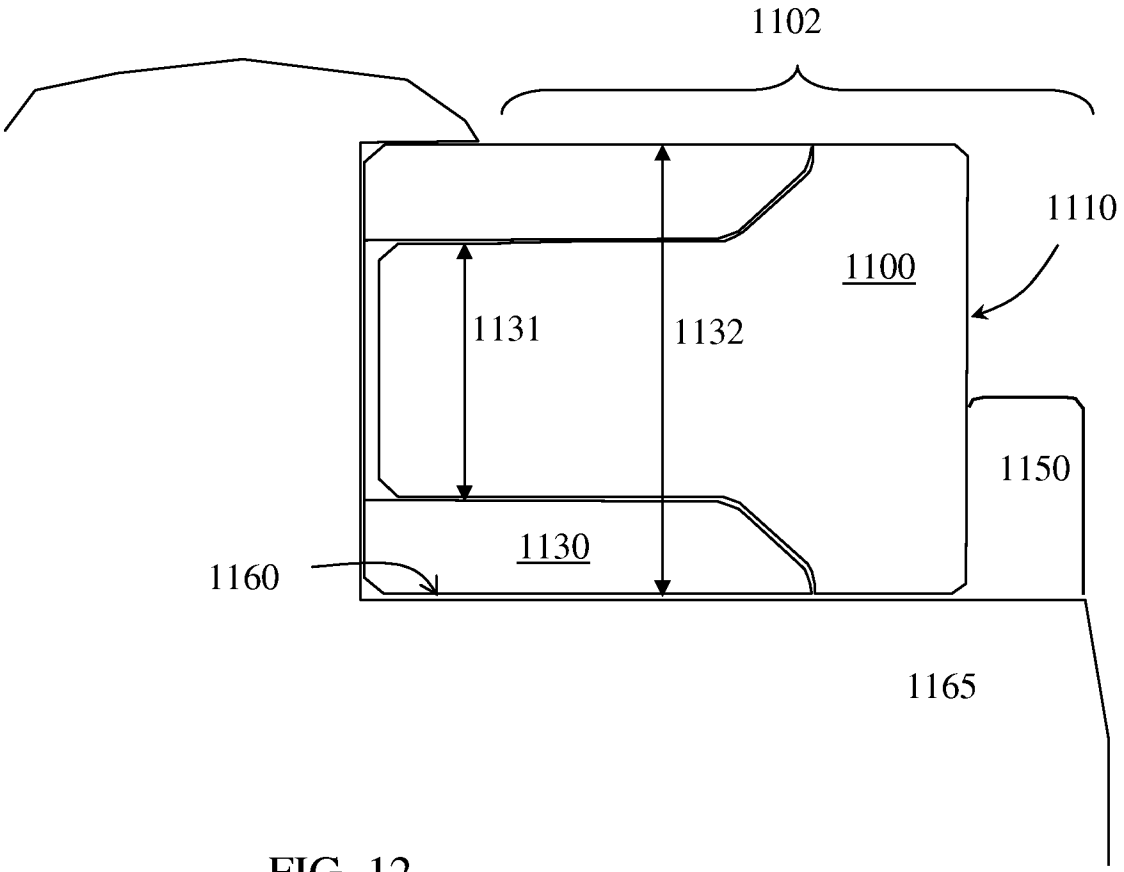
FIG. 12 shows a cross-sectional view of a cutting element assembly according to embodiments of the present disclosure.

Further, a sleeve may extend the entire length of the inner cutting element, a distance greater than the length of the inner cutting element, or a distance less than the inner cutting element. For example, referring now to FIGS. 11 and 12, a cutting element assembly 1102 is shown having a cutting element 1100 disposed in a sleeve 1130, wherein the sleeve 1130 extends a distance less than the length of the inner cutting element 1100. As shown, the cutting element 1100 has a cutting face 1110 and a body 1120 extending axially downward from the cutting face 1110. The portion of the body 1120 disposed within the sleeve 1130, which may be referred to as a shaft 1122, has a diameter smaller than the cutting face 1110 and approximately equivalent with the inner diameter 1131 of the sleeve 1130. Further, the cutting face 1110 may have a diameter approximately equivalent to the outer diameter 1132 of the sleeve 1130 so that the outer surface of the cutting element at the cutting face coincides with the outer surface of the sleeve 1130. The cutting element 1100 and sleeve 1130 may be disposed in a cutter pocket 1160 formed in a cutting tool 1165, and a blocker 1150 may then be attached to the cutter pocket 1160 adjacent to the cutting face 1110 of the cutting element 1100. In embodiments having a sleeve extend a distance less than the length of the cutting element, such as shown in FIG. 12, the blocker 1150 may be adjacent to the cutting face 1110 and cutter pocket 1165 but not the sleeve 1130. However, in other embodiments, a sleeve may extend a distance equal to the length of the cutting element, such that when the blocker is positioned adjacent to the cutting element and attached to a cutter pocket, the blocker is adjacent to a portion of each of the cutting element, the sleeve and the cutter pocket. In yet other embodiments, a sleeve may extend a distance greater than the length of the cutting element, such as shown in FIG. 2, such that when the blocker 250 is positioned adjacent to the cutting face 210 of the cutting element 200, the blocker 250 is adjacent to the cutting element 200 and the sleeve 230, but not a cutter pocket.

According to embodiments of the present disclosure, a cutting element may be rotatably retained within a sleeve or cutter pocket using a blocker in combination with one or more additional retention mechanisms. Additional retention mechanisms that may be used in combination with the blocker described herein may include retention mechanisms disposed between the inner surface of the sleeve or cutter pocket and the outer side surface of the cutting element. For example, one or more locking devices (such as described above used in attaching blockers) may be disposed between the inner surface of a sleeve or cutter pocket and the outer side surface of a cutting element. In some embodiments, a cutting element may be formed with a retention mechanism (integral with the cutting element body) that may be used in combination with the blocker described herein. For example, a cutting element may have radius along its axial length that is larger than an inner radius of the sleeve or cutter pocket, wherein the smaller inner radius of the sleeve or cutter pocket is positioned between the cutting face of the cutting element and the larger cutting element radius. Other examples of retention mechanisms that may be used in combination with the blocker assembly described herein may include those described in U.S. Pat. No. 7,703,559, which is incorporated herein by reference in its entirety.

Cutting element assemblies may be assembled and attached to a cutting tool by inserting a cutting element into a sleeve, wherein at least a portion of a cutting face and cutting edge of the cutting element is exposed. Once the cutting element is inserted into the sleeve, a blocker may then be secured to the blocker portion of the sleeve (i.e., the portion of the sleeve that is adjacent to the blocker), such as by disposing a locking device between corresponding holes formed in the blocker and the blocker portion of the sleeve, wherein the blocker covers a portion of the cutting face. Providing a blocker as a separate piece from the cutting element and sleeve and mechanically attaching it to the sleeve with a locking device, as described herein, may allow for retention of the cutting element without additional thermal attachment processes (such as brazing) while also allowing for repair and replacement of the assembly pieces.

The locking devices may be inserted into holes formed in the blocker prior to assembling the blocker into the sleeve and adjacent the cutting element, or alternatively, locking devices may be inserted into holes formed in the blocker after assembly to a sleeve. For example, a blocker may be assembled adjacent to a cutting element and the blocker portion of a sleeve, and then one or more locking devices may be inserted through a hole formed in the sleeve and into a corresponding hole formed in the blocker to attach the blocker to the sleeve.

The cutting elements of the present disclosure retained within a sleeve by a blocker may be attached to a drill bit or other cutting tool, such as a reamer, by attaching the sleeve to a cutter pocket using methods known in the art, such as by brazing. For example, according to some embodiments, a cutting element may be rotatably retained to a drill bit by retaining the cutting element in a sleeve with a blocker, as described above. The drill bit may include a bit body, a plurality of blades extending from the bit body, wherein each blade has a leading face, a trailing face, and a top face, and a plurality of cutter pockets disposed in the plurality of blades. The cutter pockets may be formed in the top face of a blade, and at the leading face, so that the cutting elements may contact and cut the working surface once disposed in the cutter pockets. A sleeve of a cutting element assembly according to embodiments disclosed herein may be attached to at least one cutter pocket with or without a rotatable cutting element disposed therein. For example, the sleeve may be attached to a cutter pocket using a brazing process known in the art. Alternatively, in other embodiments of the present disclosure, a sleeve may be infiltrated or cast directly into the blade during an infiltration or sintering process.

A rotatable cutting element may be inserted within the sleeve either before or after the sleeve is attached to a cutter pocket. A blocker may then be positioned adjacent to the cutting face of the rotatable cutting element and attached to the sleeve (or cutter pocket) using at least one locking device. Alternatively, a blocker may be used in combination with a cutting element that is mechanically attached to the sleeve such that it does not rotate within the sleeve.

According to other embodiments of the present disclosure, a cutting element may be retained directly within a cutter pocket (without the use of a sleeve) of a cutting tool, such as a drill bit or a reamer, using a blocker. For example, a cutting tool may include a tool body, a plurality of blades extending radially from the tool body, wherein each blade comprises a leading face and a trailing face, and a plurality of cutter pockets formed in the blades. At least one cutting element may be disposed in a cutter pocket formed in a blade. A blocker may then be positioned adjacent to the cutting face of the cutting element and at the leading face of the blade. The blocker may be retained to the cutter pocket using at least one locking device, such as described above. For example, the cutter pocket may have at least one hole formed in an inner wall of the cutter pocket at an axial distance between the cutting face of the cutting element and the leading face of the blade. The blocker may have a hole formed therein corresponding with each of the holes formed in the inner wall of the cutter pocket, such that when the blocker is assembled in the cutter pocket adjacent to the cutting element, the hole(s) of the blocker align with the hole(s) of the cutter pocket. A locking device may be disposed between the corresponding blocker and cutter pocket holes, thereby locking the blocker in place.

Cutting elements of the present disclosure may be machined from one piece, or may be made from more than one piece. For example, in embodiments having a diamond cutting face, a rotatable cutting element may be formed from a carbide substrate and a diamond table formed on or attached to an upper surface of the carbide substrate, such as by means known in the art. Alternatively, rotatable cutting elements of the present disclosure may be formed from more than one piece of the same material.

Various embodiments described herein may have at least one ultrahard material included therein. Such ultrahard materials may include a conventional polycrystalline diamond table (a table of interconnected diamond particles having interstitial spaces therebetween in which a metal component (such as a metal catalyst) may reside), a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultrahard material such as a cubic boron nitride. Further, in particular embodiments, an inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite.

Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is disposed may be formed of a variety of hard or ultrahard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultrahard material such as polycrystalline diamond and thermally stable diamond.

Further, it is also within the scope of the present disclosure that the rotatable cutting element may be formed from a carbide material without the use of a diamond table. Such cutting elements may be used, for example, in a lead mill or other wellbore departure tools.

Sleeves used in cutting element assemblies of the present disclosure may be formed from a variety of materials. In one embodiment, the sleeve may be formed of a suitable material such as steel, tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the sleeve is a cemented tungsten carbide with a cobalt binder. It is also within the scope of the present disclosure that the sleeve may also include more lubricious materials to reduce the coefficient of friction. The sleeve may be formed of such materials in their entirely or have a portions thereof (such as the inner surface of the upper region) including such lubricious materials. For example, the sleeve may include diamond, diamond-like coatings, or other solid film lubricant.

By attaching blockers of the present disclosure to a sleeve or cutter pocket (adjacent to a cutting element) using one or more locking devices, as described herein, a blocker may be assembled without use of additional thermal attachment processes, such as brazing. Additionally, blockers of the present disclosure may be used to help sleeves counter the bending moment of the cutting element from the drilling load. Thus, by attaching a blocker adjacent to the cutting face of a cutting element according to embodiments of the present disclosure, the blocker may also reduce damage occurring to the sleeve resulting from the drilling load.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A cutting element assembly, comprising:

a sleeve having a leading face and a trailing face;

an inner cutting element at least partially within the sleeve, the inner cutting element comprising a diamond table attached to a substrate, with the diamond table having a cutting face of the inner cutting element, the inner cutting element further including a rear face and at least one side surface extending from the cutting face toward the rear face, the cutting face of the inner cutting element being within the sleeve and between the leading face and the trailing face of the sleeve; and a blocker retained in the sleeve with at least one locking device, at least a portion of the blocker being between the cutting face of the inner cutting element and the leading face of the sleeve such that the at least a portion of the blocker covers a portion of the cutting face of the inner cutting element and restricts movement of the cutting face of the inner cutting element toward the leading face of the sleeve.

2. The cutting element assembly of claim 1, wherein the at least one locking device is disposed within at least one hole formed in a sidewall of the sleeve and at least one hole formed in a sidewall of the blocker.

3. The cutting element assembly of claim 2, wherein the at least one hole formed in the sleeve is a through hole.

4. The cutting element assembly of claim 2, wherein the at least one hole formed in the sleeve is a blind hole.

5. The cutting element assembly of claim 2, wherein the at least one hole formed in the blocker is a through hole.

6. The cutting element assembly of claim 2, wherein the at least one hole formed in the blocker is a blind hole.

7. The cutting element assembly of claim 2, wherein the at least one locking device comprises at least one pin and at least one spring biasing the pin within the at least one hole and in a direction toward or away from the sidewall of the sleeve.

8. The cutting element assembly of claim 1, wherein the at least one locking device comprises a pin.

9. The cutting element assembly of claim 1, wherein the inner cutting element is rotatably retained within the sleeve.

10. The cutting element assembly of claim 1, wherein the inner cutting element is fixed within the sleeve.

11. A cutting tool, comprising:

a tool body;

a plurality of blades extending radially from the tool body, each blade comprising a leading face and a trailing face;

a plurality of cutter pockets on the plurality of blades;

at least one cutting element in one of the cutter pockets, the at least one cutting element including an outer cutting face, a rear face, and a cylindrical side surface that extends from the outer cutting face toward the rear face; and at least one blocker positioned adjacent to and covering at least a portion of the outer cutting face of the at least one cutting element, the at least one blocker also being adjacent to the leading face of the blade, the blocker being retained to the cutter pocket with at least one locking device that includes at least one pin protruding from the blocker, the at least one pin being biased by at least one spring.

12. The cutting tool of claim 11, wherein the at least one cutting element comprises a diamond table attached to a substrate.

13. The cutting tool of claim 12, wherein the diamond table defines the outer cutting face, the substrate defines the rear face, and the substrate and diamond table collectively define the cylindrical side surface.

14. The cutting tool of claim 11, wherein the cutter pocket comprises at least one hole formed in an inner side wall of the cutter pocket at an axial distance measured between the outer cutting face of the cutting element and the leading face of the blade.

15. The cutting tool of claim 14, wherein the at least one locking device is disposed between at least one hole formed in the cutter pocket and at least one hole formed in the blocker.

16. The cutting tool of claim 15, wherein the at least one hole formed in the blocker is a through hole.

17. The cutting tool of claim 15, wherein the at least one hole formed in the blocker consists of a blind hole.

18. The cutting tool of claim 11, wherein the at least one spring biasing the at least one pin is located within the blocker or within a hole formed in at least one of a sleeve around the at least one cutting element or a wall of the one of the cutter pockets.

19. The cutting tool of claim 11, wherein the cutting element is rotatably retained within the cutter pocket.

20. The cutting tool of claim 11, wherein the cutting element is fixed within the cutter pocket.

21. The cutting tool of claim 11, wherein an outer surface of the blocker is flush with the leading face of the blade.

22. The cutting tool of claim 11, wherein the cutting tool is a drill bit.

23. The cutting tool of claim 11, wherein the cutting tool is a reamer.

24. The cutting tool of claim 11, wherein the cutting tool is a wellbore departure tool.

* * * * *